US006861795B2

(12) United States Patent
Kakigi

(10) Patent No.: US 6,861,795 B2
(45) Date of Patent: Mar. 1, 2005

(54) FUNNEL FOR CATHODE RAY TUBE

(75) Inventor: Hiroshi Kakigi, Otsu (JP)

(73) Assignee: Nippon Electric Glass Co., Ltd., Shiga-ken (JP)

( * ) Notice: Subject to any disclaimer, the term of this patent is extended or adjusted under 35 U.S.C. 154(b) by 116 days.

(21) Appl. No.: 10/125,779

(22) Filed: Apr. 17, 2002

(65) Prior Publication Data

US 2002/0180333 A1 Dec. 5, 2002

(30) Foreign Application Priority Data

Apr. 17, 2001 (JP) ..... 2001-117631
Dec. 19, 2001 (JP) ..... 2001-385344

(51) Int. Cl.[7] ..... H01J 29/86
(52) U.S. Cl. ..... 313/477 R; 313/478; 313/479
(58) Field of Search ..... 313/477 R, 478, 313/477 NC, 479; 348/823, 805, 808, 821; 220/2.1 A, 2.3 R

(56) References Cited

U.S. PATENT DOCUMENTS 6,002,203 A 12/1999 Yokota et al. ..... 313/477
6,335,588 B1 * 1/2002 Kim et al. ..... 313/402
6,392,336 B1 * 5/2002 Sugawara et al. ..... 313/477 R

FOREIGN PATENT DOCUMENTS

JP 9-320492 12/1997
JP 2000-113840 4/2000

* cited by examiner

*Primary Examiner*—Nimeshkumar D. Patel
*Assistant Examiner*—Ken A Berck
(74) *Attorney, Agent, or Firm*—J.C. Patents

(57) ABSTRACT

A funnel for a cathode ray tube has a relationship $0<\alpha(z)<d$ in an arbitrary cross section P(z) parallel with a plane including an open end portion, where $\alpha(z)$ is an angle (°) defined between a line and a major axis (LA) of the funnel, the line being connecting an outermost part D(z) on at least one of an outer surface and an inner surface of the body portion and a center axis (C) of the funnel, and d is an angle (°) defined between a diagonal axis (DA) of the funnel and the major axis (LA).

16 Claims, 7 Drawing Sheets

FIG. 6 (A) (PRIOR ART)
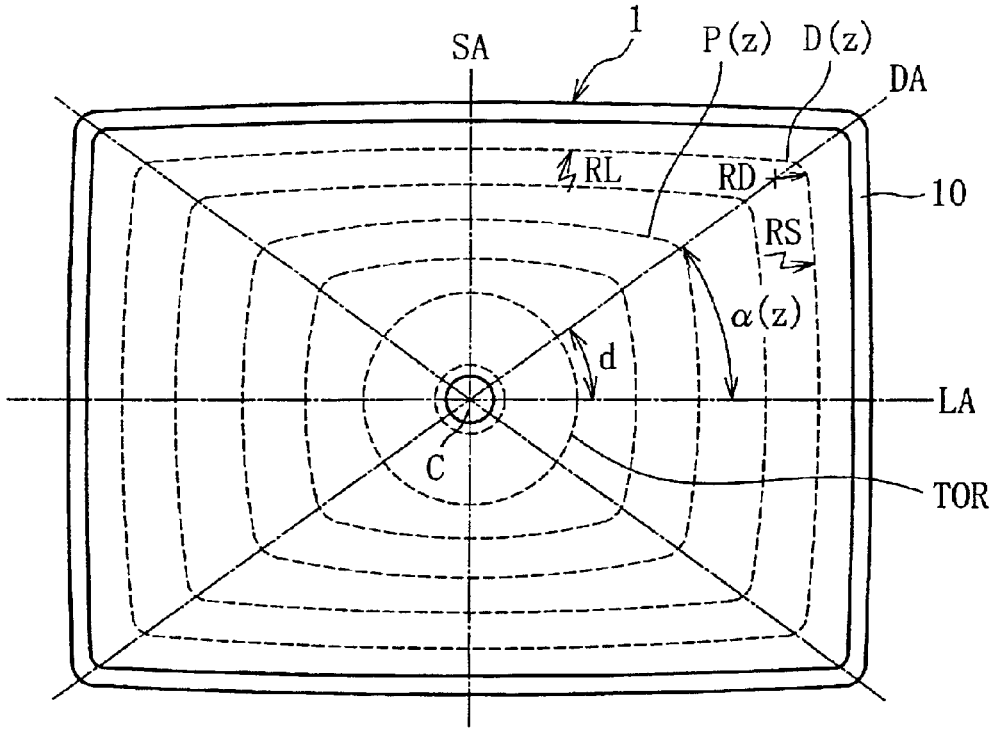
FIG. 6 (B) (PRIOR ART)
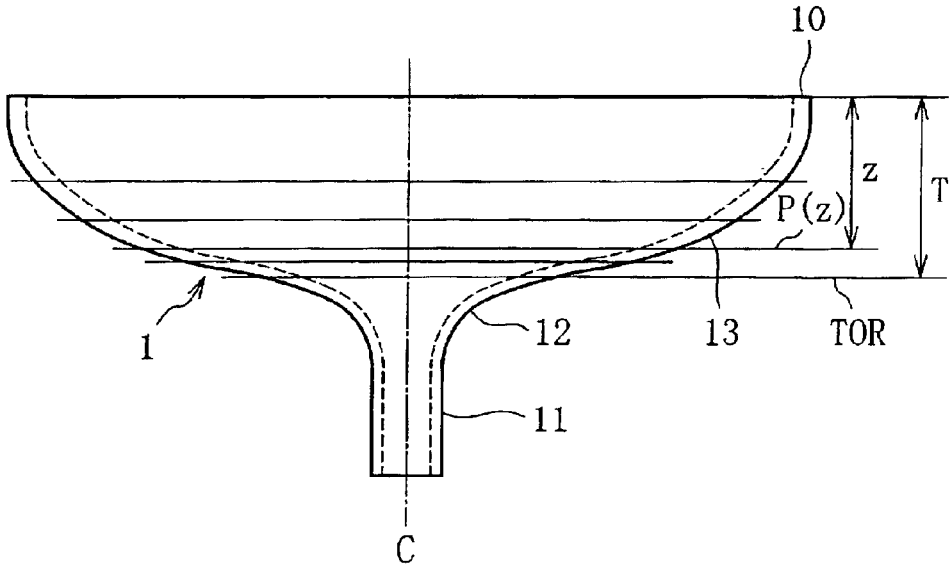

FUNNEL FOR CATHODE RAY TUBE

BACKGROUND OF THE INVENTION

The present invention relates to a funnel constituting a glass bulb for a cathode ray tube.

The glass bulb for a cathode ray tube comprises a front panel on which an image is displayed, and a rear funnel which is sealed to the panel for forming a glass envelope. As shown in FIG. 6, the funnel 1 comprises an open end portion 10 in an approximately rectangular shape similar to the panel, a neck portion 11 in a cylindrical shape for mounting an electron gun, a yoke portion 12 on which a deflection coil is externally mounted, and a body portion 13 in a funnel-shape which gradually changes in a direction from the open end portion 10 to the yoke portion 12. The joint portion between the yoke portion 12 and the body portion 13 is generally called TOR (Top Of Round).

The contour of a cross section P(z) of the body portion 13 in parallel with the open end portion 10 is a rectangle similar to the open end portion 10 in the vicinity of the open end portion 10 (z=0), and is generally a circle in the vicinity of the yoke portion 12 (z=T). The contours of the inner surface and the outer surface of the cross section P(z) respectively comprise three arcs, which are arcs RL constituting longer sides, arcs RS constituting shorter sides, and arcs RD in contact with the longer side and the shorter side.

An angle d (°) defined between a diagonal axis (DA) and the major axis (LA) is 36.87° when the aspect ratio of the display surface is 4:3, and the angle d is 29.36° when the aspect ratio is 16:9. The center of the arc RD is conventionally set on the diagonal axis (DA) for the sake of design, so that the outermost part D(z) of the contour of the cross section P(z) exists on the diagonal axis (DA) as well. In such funnel 1, since the contour of the body portion 13 suddenly changes in the vicinity of the diagonal axes (DA), ridge-like corner shapes approximately parallel with the diagonal axis are formed especially on the longer side of the diagonal axes. Especially, because the wide screen type funnel having the aspect ratio of 16:9 has the larger ratio of the longer side to the shorter side, the ridge-like corner shapes are remarkable.

Generally a press molding is used for manufacturing the funnel. As shown in FIG. 7, after a certain amount of molten glass gob is supplied into a bottom mold 20, a plunger (not shown) is pressed against the molten glass gob, thereby the molten glass gob is extended in a gap between the bottom mold 20 and the plunger to mold the funnel. FIG. 7 shows the funnel 1 in a state of completion of pressing and extending (in a state of fill up). FIG. 8 shows the funnel 1 in a state of midway of pressing and extending the molten glass gob in the bottom mold 20. Arrows 14 in FIG. 8 shows a direction of pressing and extending the molten glass. The molten glass is pressed and extended up to the open end portion on a minor axis (SA), the major axis (LA), and the diagonal axis (DA) in this order.

As described before, the ridge-like corner shapes approximately parallel with the diagonal axis are formed in the vicinity of the diagonal axes of the funnel, and these shapes inhibit the pressing and extending of the glass when the funnel is press-molded. Namely, as shown by the arrow 14 in FIG. 8, the glass is extended in the direction of the diagonal axis while wrapping around both from the minor axis side and the major axis side. However, since a resistance against the pressing and extending increases at the ridge-like corner shapes, the fill-up of the glass up to the open end portion is delayed at the corner shapes in comparison with the rest portions.

Since the fill-up is delayed on the diagonal axes in this way, the temperature of the glass filled in the open end portion in the vicinity of the diagonal axes decreases, so that the problems such as generation of small cracks in the glass, increase of time required for the fill-up, or increase of pressing pressure occur. The ridge-like corner shapes are also disadvantageous in terms of strength. Namely, scratches generated as a result of handling the funnel tend to concentrate at the ridge-like corner shapes. Also, when the funnel is used to constitute a cathode ray tube, the inside of the funnel is evacuated, so that a vacuum stress generated from a difference between an inner air pressure and an outer air pressure tends to concentrate at the ridge-like corner shapes. It is undeniable that the cathode ray tube may break depending on degree of the scratches and the vacuum stress.

SUMMARY OF THE INVENTION

It is an object of the present invention to provide a funnel which is used for a cathode ray tube, whose body portion has a shape proper for press molding, and which is advantageous in terms of strength.

To attain the object above, the present invention provides a funnel for a cathode ray tube comprising an open end portion in an approximately rectangular shape, a neck portion for mounting an electron gun, a yoke portion on which a deflection coil is externally mounted, and a body portion constituting a part between the open end portion and the yoke portion, the body portion having a funnel-shape whose cross section parallel with a plane including the open end portion is continuously changing in a direction from the open end portion to the yoke portion, wherein a relationship $0<\alpha(z)<d$ is satisfied in an arbitrary cross section P(z) parallel with the plane including the open end portion, where $\alpha(z)$ is an angle (°) defined between a line and a major axis (LA) of the funnel, the line being connecting an outermost part D(z) on at least one of an outer surface and an inner surface of the body portion and a center axis (C) of the funnel, and d is an angle (°) defined between a diagonal axis (DA) and the major axis (LA) of the funnel.

In the above constitution, it is preferable that the angle $\alpha(z)$ be represented a function of non-monotonic increasing or non-monotonic decreasing continuously changing from the open end portion (z=0) to a joint portion (z=T) to the yoke portion, and having one minimum value.

To attain the object above, the present invention also provides a funnel for a cathode ray tube comprising an open end portion in an approximately rectangular shape, a neck portion for mounting an electron gun, a yoke portion on which a deflection coil is externally mounted, and a body portion constituting a part between the open end portion and the yoke portion, the body portion having a funnel-shape whose cross section parallel with a plane including the open end portion is continuously changing in a direction from the open end portion to the yoke portion, wherein a relationship $d<\alpha(z)<90$ is satisfied in an arbitrary cross section P(z) parallel with the plane including the open end portion, where $\alpha(z)$ is an angle (°) defined between a line and a major axis (LA) of the funnel, the line being connecting an outermost part D(z) on at least one of an outer surface and an inner surface of the body portion and a center axis (C) of the funnel, and d is an angle (°) defined between a diagonal axis (DA) and the major axis (LA) of the funnel.

In the constitution above, it is preferable that the angle $\alpha(z)$ be represented by a function of non-monotonic increasing or non-monotonic decreasing continuously changing from the open end portion (z=0) to a joint to the yoke portion (z=T), and having one maximum value.

It is preferable that the angle $\alpha(z)$ and the angle d satisfy $0<|\alpha(z)-d|<10$. Here, the arithmetic symbol || represents an absolute value.

In the constitution above, it is preferable that, when the outermost part D(z) on at least one of an outer surface and an inner surface of the body portion is represented as (Dx, Dy) on an orthogonal coordinate defined by the major axis (LA) and a minor axis (SA) of the funnel in the arbitrary cross section P(z) parallel with the plane including the open end portion, Dx and Dy in a range where (z) changes from 0 to T satisfy a relationship $$Dy=A_0+A_1\cdot Dx+A_2\cdot Dx^2+\ldots+A_{n-1}\cdot Dx^{n-1}+A_n\cdot Dx^n,$$

where $A_0, A_1, A_2, \ldots, A_{n-1}$ and $A_n$ are constants, and n is a natural number.

Because the center of an arc RD forming the outermost part D(z) of the body portion of the funnel is provided toward the shorter side or the longer side from the diagonal axis of the funnel in the present invention, the outermost part D(z) is also shifted toward the shorter side or the longer side from the diagonal axis of the funnel. As a result, either curvature radius of arcs constituting the longer side and the short side respectively is reduced, and the ridge-like corner shapes in the vicinity of the diagonal axes are eased. As a result, the moldability of the funnel is improved, and the probability of the breakage of the funnel caused by the scratches and the vacuum stress concentrated on the ridge-like corner shapes is reduced.

It is preferable for smoothing the pressing and extending of the glass and improving the moldability thereof that the body portion constituting the part between the open end portion and the yoke portion has the funnel-shape smoothly continuously changing from the open end portion to the yoke portion. Thus, the angle by which the outermost part is distant from the diagonal axis around the center axis, namely $[\alpha(z)-d]$, is less than +/−10°, and more preferably less than +/−5°. If $|\alpha(z)-d|$ is 10 or more, it is difficult to make the body portion join to the open end portion or the yoke portion.

Also, the funnel is formed such that the angle $\alpha(z)$ is represented by a function of non-monotonic increasing or non-monotonic decreasing continuously changing from the open end portion (z=0) to the joint portion (z=T) to the yoke portion, and having one minimum or maximum value between the open end portion and the yoke portion. If there are two or more maximum values or minimum values, the shape becomes complicated. As a result, it is difficult to machine the mold for press molding, and the moldability cannot be improved.

When the outermost part D(z) on at least either one of the outer surface and the inner surface of the body portion is represented as (Dx, Dy) on an orthogonal coordinate defined by the major axis (LA) and the minor axis (SA) in the arbitrary cross section P(z) from the open end portion (z=0) to the joint portion (z=T) to the yoke portion, Dx and Dy in the range where z changes from 0 to T satisfy the relationship $$Dy=A_0+A_1\cdot Dx+A_2\cdot Dx^2+\ldots+A_{n-1}\cdot Dx^{n-1}+A_n\cdot Dx^n,$$

where $A_0, A_1, A_2, \ldots, A_{n-1}$ and $A_n$ are constants, and n is a natural number. As a result, the change of the shape of the outermost part from the open end portion to the yoke portion becomes continuous and smooth.

It is preferable that the order of the polynomial is 2 or 3. Namely, when the order is 1, the change of the shape of the outermost part is linear. When the order is 4 or more, the shape becomes unnecessarily complicated.

Because the body portion of the funnel for a cathode ray tube of the present invention has a shape proper for press molding, the pressing and extending of the glass becomes smooth during the press molding. As a result, small cracks due to the delay of the pressing and extending of the glass are restrained from generating on the open end portion in the vicinity of the diagonal axes. Also the problems such as the increase of the time required for fill-up, and the increase of the press pressure are solved.

The scratches generated on the outer surface at the diagonal axes of the body portion by handling the funnel are restrained. The vacuum stress generated in the stage of forming the cathode ray tube is distributed. As a result, an excellent effect of restraining the possibility of a breakage of the funnel or the cathode ray tube is obtained.

BRIEF DESCRIPTION OF THE DRAWINGS

In the accompanying drawings:

FIG. 6 includes a front view (FIG. 6(*a*)) and a side view (FIG. 6(*b*)) of a conventional funnel for a cathode ray tube;

DETAILED DESCRIPTION OF THE PREFERRED EMBODIMENTS

Figure 7:
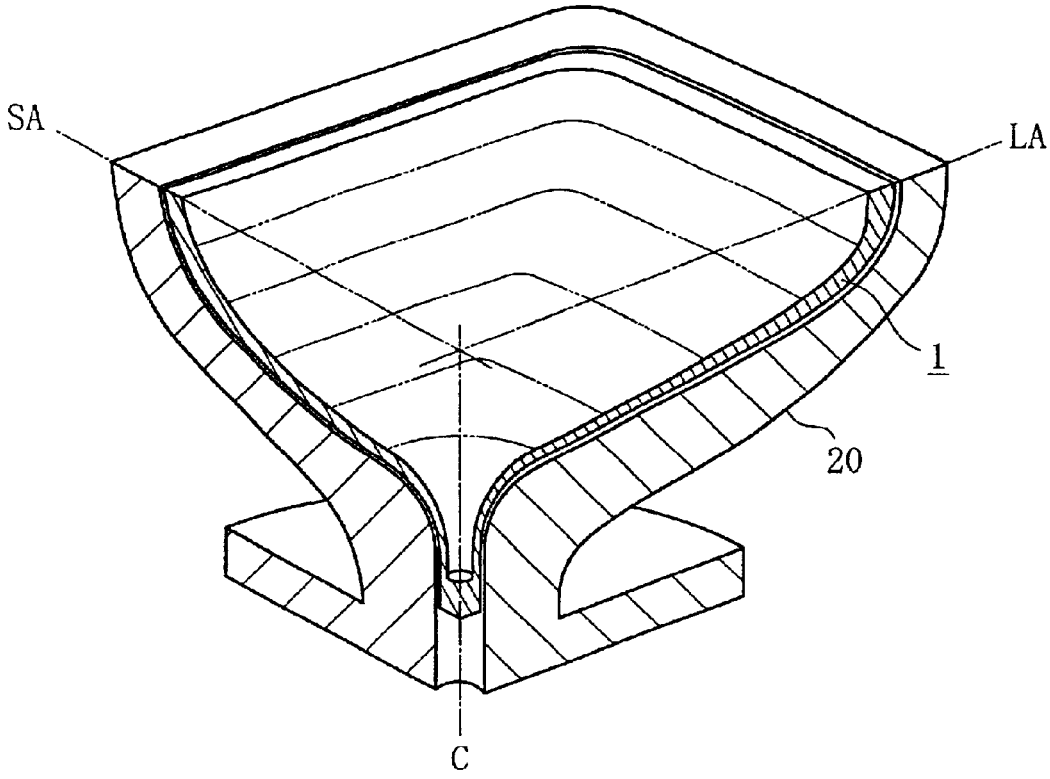
FIG. 7 is a perspective sectional view of a principal part for showing a state where pressing and extending of glass is completed (in a fill-up state) when the funnel for a cathode ray tube is press-formed.
Figure 8:
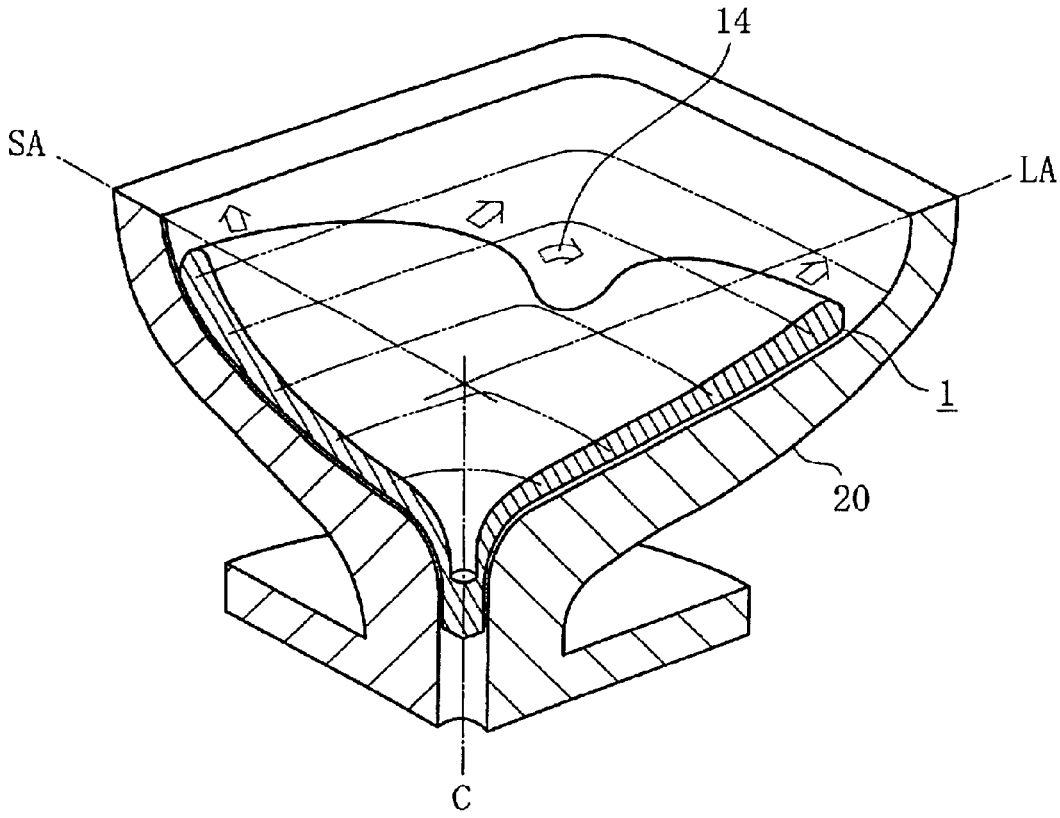
FIG. 8 is a perspective sectional view of a principal part for showing a state where pressing and extending the glass is in progress when the funnel for a cathode ray tube is press-formed.

The following section describes an embodiment of a funnel for a cathode ray tube (size: 76 cm, aspect ratio: 16:9, deflection angle: 120°, and neck outside diameter: 29.1 mm) based on FIG. 1 to FIG. 4. Constitution elements common to those in FIG. 6 through FIG. 8 are given the same numerals and detailed description for them is omitted in the following description.

Figure 1:
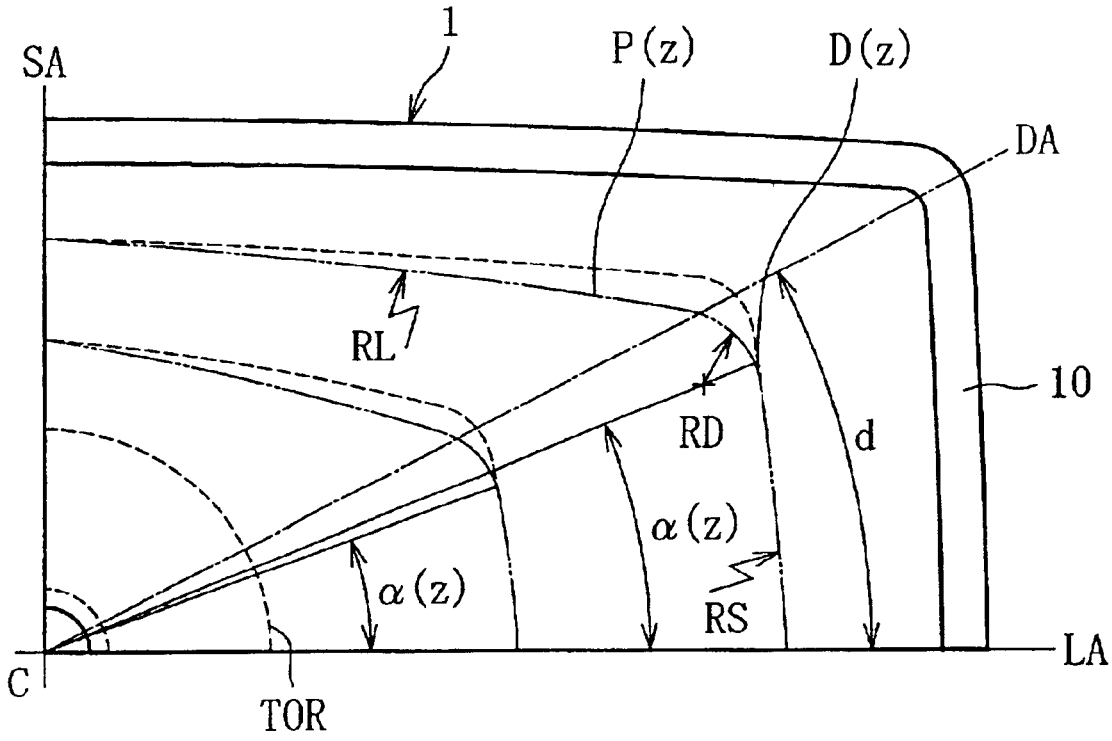
FIG. 1 is the first quadrant of a front view of a funnel for a cathode ray tube according to an embodiment of the present invention.

FIG. 1 is the first quadrant of a front view of a funnel for a cathode ray tube according to an embodiment. A chain double-dashed line shows a contour of an outer surface on a cross section P(z) of the embodiment. A dashed line shows a contour of an outer surface on the cross section of a conventional funnel for a cathode ray tube. For example, values of three arcs RL, RD, and RS at z=60 (mm) are RL=4072 mm, RD=40 mm, and RS=636 mm for the contour of the outer surface of the conventional funnel represented as the dashed line, and RL=1459 mm, RD=40 mm, and RS=933 mm for the contour of the outer surface of the embodiment represented as the chain double-dashed line. For the sake of simple description, only the first quadrant of the funnels for a cathode ray tube is shown. However, the second to fourth quadrants are respectively constituted as symmetrical to the first quadrant about axes.

Table 1 shows distances from the center axis (C) of the funnel to the contour of the outer surface in the cross section P(z) at z=60 mm, making a comparison between the contour of the conventional funnel (shown as Po in Table 1) and that of the embodiment (shown Pp in Table 1) Values shown in Table 1 are design values (unit: mm) calculated for every 100 around the center axis (C) from the major axis (LA) to the minor axis (SA).

TABLE 1

| Angle (°) | LA | 10 | 20 | DA | 30 | 40 | 50 | 60 | 70 | 80 | SA |
|---|---|---|---|---|---|---|---|---|---|---|---|
| Po | 335.3 | 337.7 | 345.1 | 355.4 | 355.2 | 306.8 | 261.8 | 233.6 | 216.4 | 207.0 | 204.0 |
| Pp | 335.3 | 338.6 | 348.7 | 348.1 | 345.2 | 290.8 | 254.3 | 230.3 | 215.1 | 206.7 | 204.0 |
| Difference | 0.0 | 0.9 | 3.6 | −7.3 | −10.0 | −16.0 | −7.3 | −3.3 | −1.3 | −0.3 | 0.0 |

As clearly from the above, in the cross section P(z) of the embodiment, the curvature radius of the arc RL on the longer side is largely decreased, and the distance of the contour from the center axis (C) forms a rounded shape in degree of 16 mm at 40° around the center axis (C), thus the ridge-like corner shape in the vicinity of the diagonal axis is eased. Though an illustration in the drawing is omitted for the sake of simple description, it is designed such that an angle defined between a line, which connects the outermost part on the inner surface and the center axis (C), and the major axis (LA) in the cross section P(z) is the same as that angle of the outer surface.

As a result of study of the present inventors, when the arc on the longer side or the shorter side in the contour of the cross section of the body portion have a curvature radius more than 3000 mm, the ridge-like corner shape in the vicinity of the diagonal axis becomes noticeable and most remarkably eased with the present invention.

Figure 2:
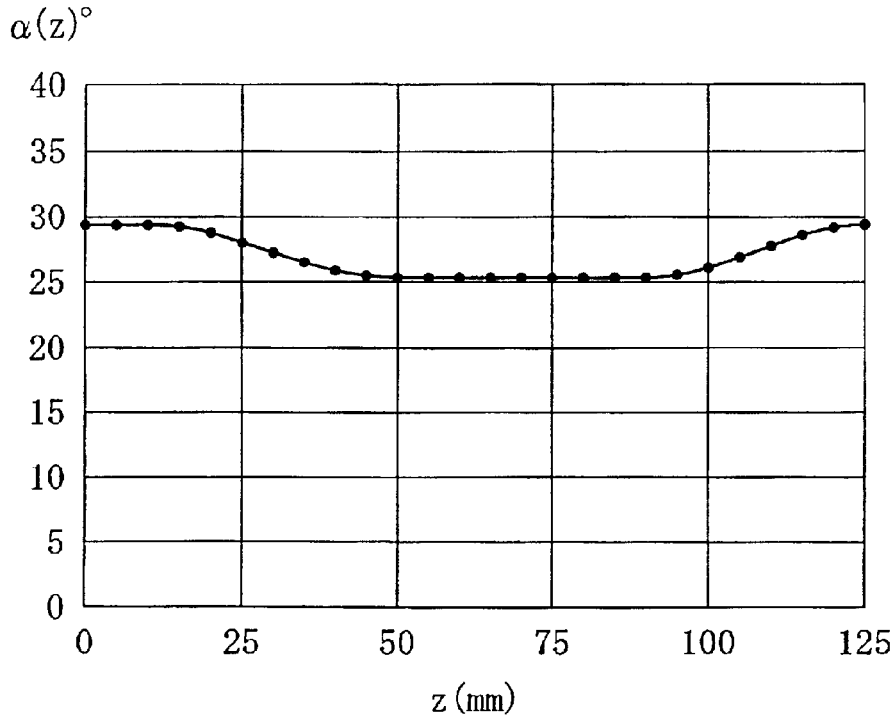
FIG. 2 includes a chart (FIG. 2(A)) for showing a curve $\alpha(z)$ of a contour of an outer surface, and a chart (FIG. 2(B)) for showing a curve $[\alpha(z)-d]$ for a cross section of a body portion of a funnel for a cathode ray tube according to an embodiment.
Figure 2:
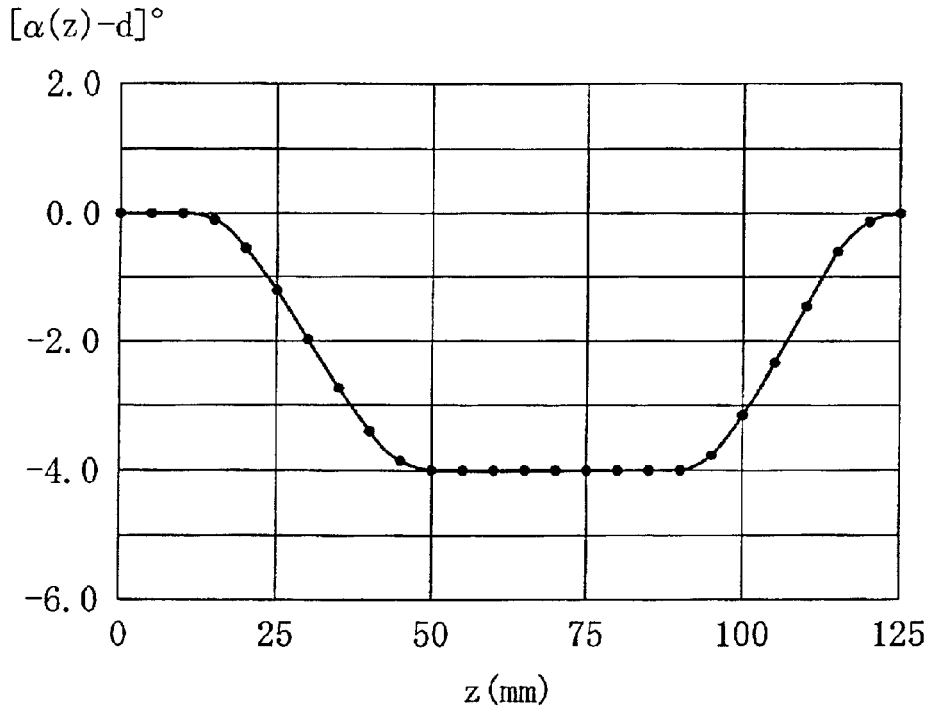

FIG. 2 shows curves for $\alpha(z)$ and $[\alpha(z)-d]$ when the distance (z) in the direction of the center axis changes from the open end portion (z=0) to the joint portion (z=125 mm) to the yoke portion. The outermost part D(z) exists on the side of the major axis (LA) with respect to the diagonal axis (29.36°) in a range where z is 10 mm to 125 mm for the funnel of the embodiment. It is observed that $[\alpha(z)-d]$ has the minimum value of −4° in a range where (z) is 50 mm to 90 mm. $\alpha(z)$ is a curve which smoothly continuously changes from the open end portion (z=0 mm) to the joint portion (z=125 mm) to the yoke portion, and is not a monotonically increasing or decreasing function.

Figure 3:
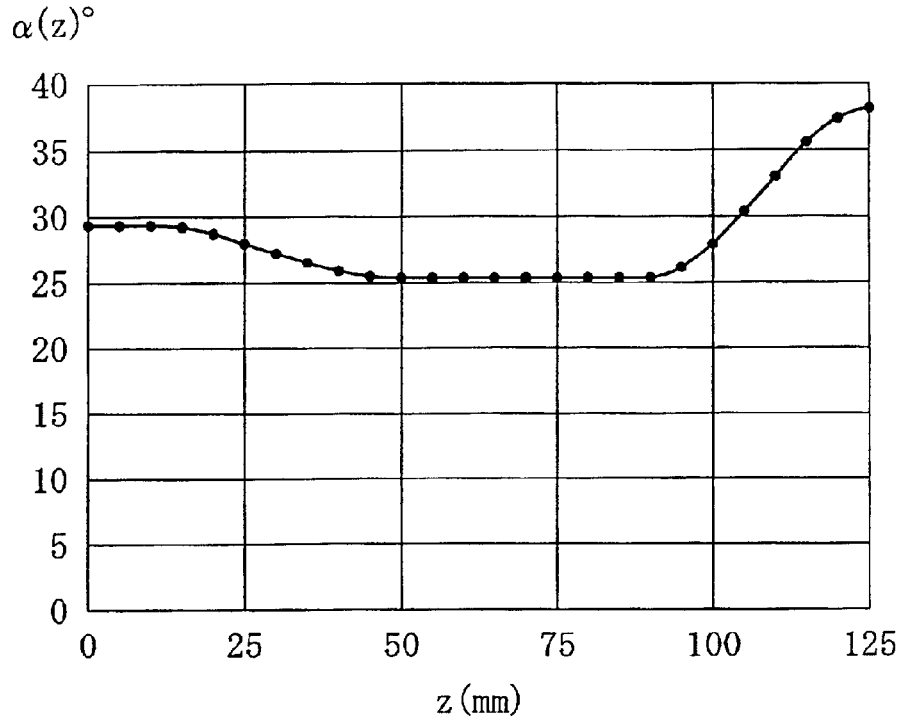
FIG. 3 includes a chart (FIG. 3(A)) for showing a curve $\alpha(z)$ of a contour of an outer surface, and a chart (FIG. 3(B)) for showing a curve $[\alpha(z)-d]$ for a cross section of a body portion of a funnel for a cathode ray tube according to an alternative embodiment.
Figure 3:
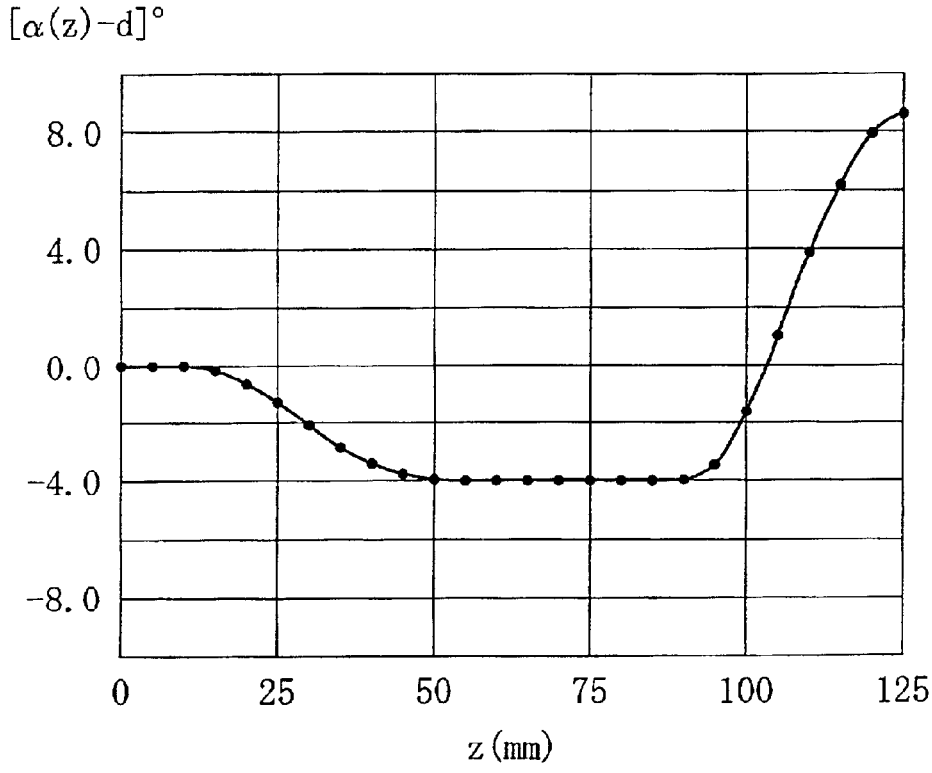

FIG. 3 shows an alternative embodiment relating to a funnel with a size the same as the embodiment described above. Namely, while the embodiment shown in FIG. 2 has a rounded yoke portion, the embodiment shown in FIG. 3 has a non-round yoke portion, a so-called rectangular yoke portion.

Cathode ray tubes with the rectangular yoke portion have been developed for reducing power consumption. With the rectangular yoke portion, efficiency of deflecting electron beams is increased by increasing the inside diameter as much as possible for avoiding the collision with the electron beams at the diagonal corners where the electron beams tend to collide, and reducing the inside diameter in the vicinity of the major axis and the minor axis as much as possible for making a deflection coil as close to the electron beams as possible.

For a funnel having the rectangular yoke portion, it is necessary to consider a strength to withstand air pressure when the inside is evacuated for completing a cathode ray tube, and to avoid an extreme non-round shape. Thus, the following funnel constitution is proposed. The yoke portion thereof on which the deflection coil is externally mounted is circular at the side of the neck portion, and gradually changes to a non-circular which has the largest diameter in a direction other than the major axis and the minor axis along the direction toward the panel. As a result, an angle defined between a line, which connects the outermost part and the center axis, and the major axis at the joint portion of the yoke portion to the body portion is different from an angle defined between a line, which connects an outermost part of the open end portion and the center axis, and the major axis, namely an angle of the diagonal axis of the funnel.

In FIG. 3, the angle defined between the line, which connects the outermost part D(z) of the contour of the outer surface and the center axis, and the major axis in the cross section is 38° at the joint portion (z=125 mm) of the rectangular yoke portion to the body portion. The angle $\alpha(z)$ for the outermost part D(z) changes from 25.36° to 38° in a range where z is 90 mm to 125 mm.

Even when a funnel has the rectangular yoke portion, if the angle defined between the line, which connects the outermost part and the center axis, and the major axis at the joint portion of the yoke portion to the body portion is the same as the angle defined between the line, which connects the outermost part of the open end portion and the center axis, and the major axis, namely the angle of the diagonal axis of the funnel, the embodiment shown in FIG. 2 is directly applied to this funnel.

Figure 4:
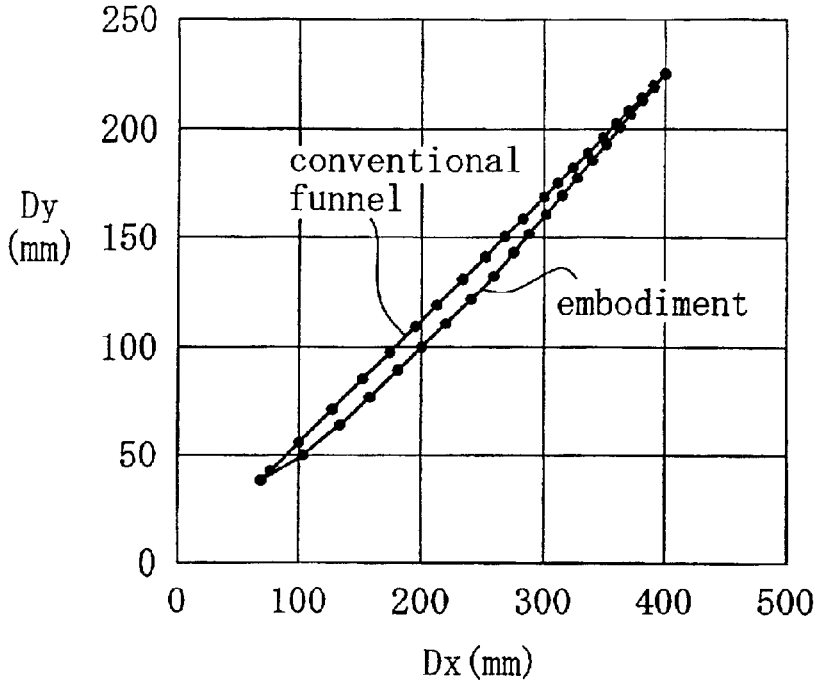
FIG. 4 is a drawing for showing a trajectory of the outermost part D(z) on the first quadrant of a rear view of a funnel for a cathode ray tube according to an embodiment.

FIG. 4 shows an alternative embodiment of the funnel for a cathode ray tube of the present invention (size: 86 cm, aspect ratio: 16:9, deflection angle: 106°, and neck outside diameter: 32.5 mm).

In FIG. 4, a trajectory of the outermost part D(z) is shown on an orthogonal coordinate defined by the major axis LA and the minor axis SA in a range where the distance z in the direction of center axis changes from the open end portion (z=0 mm) to the joint portion (z=225 mm) to the yoke portion, making a comparison between the embodiment and the conventional funnel.

For example, values of three arcs RL, RD, and RS at z=60 (mm) shown in FIG. 1 are RL=3112 mm, RD=37 mm, and RS=836 mm for the contour of the outer surface of the conventional funnel represented as the dashed line, and RL=2676 mm, RD=37 mm, and RS=888 mm for the contour of the outer surface of the embodiment represented as the chain double-dashed line. It is observed that the curvature radius of the arc RL on the longer side decreases largely in the embodiment.

As to the contour of the outer surface in the cross section P(z) at z=60 mm, when distances from the center axis (C) for the contour of the conventional funnel and the contour of the embodiment are compared with each other as the same way as described before, the distance of the contour from the center axis (C) forms a rounded shape in degree of 2.7 mm at 40° around the center axis (C), thus the ridge-like corner shape in the vicinity of the diagonal axis is eased.

The curves $\alpha(z)$ and $[\alpha(z)-d]$ corresponding to those in FIG. 2 are examined. When the distance (z) in the direction of the center axis changes from the open end portion (z=0) to the joint portion (z=225 mm) to the yoke portion, it is observed in the funnel of the embodiment that the outermost part exists on the side of the major axis (LA) with respect to the diagonal axis (29.36°) in a range of z from 10 mm to 225 mm, and that $[\alpha(z)-d]$ has the minimum value of −3.8° when z=210 mm.

In the embodiment, when the outermost part D(z) is represented as (Dx, Dy) on the orthogonal coordinate defined by the major axis LA and the minor axis SA, Dx and Dy satisfy the following second order equation in a range where z changes 0 to 225 mm. Namely, the equation is $$Dy\text{-}A_0+A_1\cdot Dx+A_2\cdot Dx^2,\ \text{where } A_0=9.748055E+00,\ A_1=3.523432E-01,\ \text{and } A_2=4.684941E-04.$$

As the description above clearly states, because the funnel of the embodiment has a more rounded shape than the conventional funnel in the contour of the cross section at the vicinity of the diagonal axis on the body portion, the glass is pressed and extended smoothly when the funnel is formed.

Figure 5:
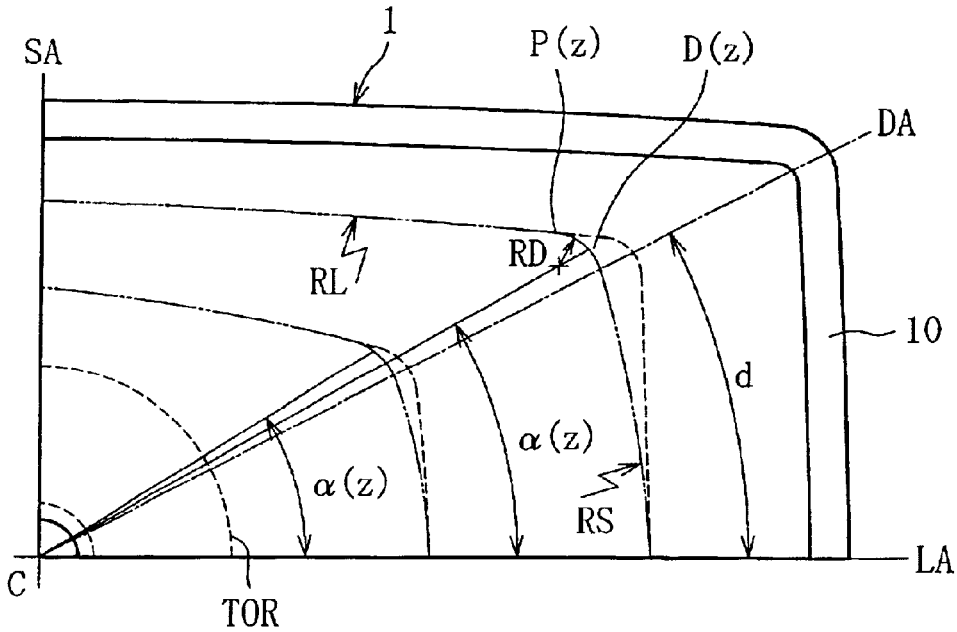
FIG. 5 is the first quadrant of a front view of a funnel for a cathode ray tube according to an alternative embodiment.

The center of the arc RD forming the outermost part is shifted to the side of the shorter side with respect to the diagonal axis on the body portion of the funnel in the embodiment, so that the curvature radius of the longer side is reduced to ease the ridge-like corner shape on the side of the longer side in the vicinity of the diagonal axis. However, as shown in FIG. 5, it is clear that the center of the arc RD may be shifted to the side of the longer side with respect to the diagonal axis, so that the curvature radius of the shorter sides is reduced to ease the ridge-like corner shape on the side of the shorter side in the vicinity of the diagonal axis, according to the shape of the funnel as required.

The center of the arc RD forming the outermost part is shifted from the diagonal axis as to both of the outer surface and the inner surface of the body portion of the funnel in the embodiment. However, the present invention may be applied only to one of the outer surface and the inner surface, according to condition such as the size of the funnel or the deflection angle, or the like. Further, when the center of the arc RD forming the outermost part is shifted from the diagonal axis of the funnel as to both of the outer surface and the inner surface, $\alpha(z)$, and the equation for the relationship between Dx and Dy may be different between on the outer surface and on the inner surface from each other.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A funnel for a cathode ray tube comprising:

an open end portion in an approximate rectangular shape;

a neck portion for mounting an electron gun;

a yoke portion on which a deflection coil is externally mounted; and a body portion constituting a part between the open end portion and the yoke portion, the body portion having a funnel-shape whose cross section parallel with a plane including the open end portion is continuously changing in a direction from the open end portion to the yoke portion;

wherein a relationship $0<\alpha(z)<d$ is satisfied in an arbitrary cross section P(z) parallel with the plane including the open portion, where $\alpha(z)$ is an angle (°) defined between a line and a major axis (LA) of the funnel, the line being connecting an outermost part D(z) on at least one of an outer surface and an inner surface of the body portion and a center axis (C) of the funnel, and d is an angle (°) defined between a diagonal axis (DA) of the funnel and the major axis (LA).

2. The funnel for a cathode ray tube according to claim 1, wherein the angle $\alpha(z)$ is represented by a function of non-monotonic increasing or non-monotonic decreasing continuously changing from the open end portion (z=0) to joint portion (z=T) to the yoke portion, and having one minimum value.

3. A funnel for a cathode ray tube comprising:

an open end portion in an approximate rectangular shape;

a neck portion for mounting an electron gun;

a yoke portion on which a deflection coil is externally mounted; and a body portion constituting a part between the open end portion and the yoke portion, the body portion having a funnel-shape whose cross section parallel with a plane including the open end portion is continuously changing in a direction from the open end portion to the yoke portion;

wherein a relationship $d<\alpha(z)<90$ is satisfied in an arbitrary cross section P(z) parallel with the plane including the open portion, where $\alpha(z)$ is an angle (°) defined between a line and a major axis (LA) of the funnel, the line being connecting an outermost part D(z) on at least one of an outer surface and an inner surface of the body portion and a center axis (C) of the funnel, and d is an angle (°) defined between a diagonal axis (DA) of the funnel and the major axis (LA).

4. The funnel for a cathode ray tube according to claim 3, wherein the angle $\alpha(z)$ is represented by a function of non-monotonic increasing or non-monotonic decreasing continuously changing from the open end portion (z=0) to a joint portion (z=T) to the yoke portion, and having one minimum value.

5. The funnel for a cathode ray tube according to claim 2, wherein the angle $\alpha(z)$ and the angle d satisfy $0<|\alpha(z)-d|<10$.

6. The funnel for a cathode ray tube according to claim 5, wherein, when the outermost part D(z) is represented as (Dx, Dy) on an orthogonal coordinate defined by the major axis (LA) and a minor axis (SA) of the funnel in the arbitrary cross section P(z), Dx and Dy in a range where (z) changes from 0 to T satisfy a relationship $$Dy=A_0+A_1\cdot Dx+A_2\cdot Dx^2+\ldots+A_{n-1}\cdot Dx^{n-1}+A_n\cdot Dx^n,$$

where $A_0, A_1, A_2, \ldots, A_{n-1}$ and $A_n$ are constants, and n is a natural number.

7. The funnel for a cathode ray tube according to claim 4, wherein the angle $\alpha(z)$ and the angle d satisfy $0<|\alpha(z)-d|<10$.

8. The funnel for a cathode ray tube according to claim 7, wherein, when the outermost part D(z) is represented as (Dx, Dy) on an orthogonal coordinate defined by the major axis (LA) and a minor axis (SA) of the funnel in the arbitrary cross section P(z), Dx and Dy in a range where (z) changes from 0 to T satisfy a relationship $$Dy=A_0+A_1\cdot Dx+A_2\cdot Dx^2+\ldots+A_{n-1}\cdot Dx^{n-1}+A_n\cdot Dx^n,$$

where $A_0, A_1, A_2, \ldots, A_{n-1}$ and $A_n$ are constants, and n is a natural number.

9. A funnel for a cathode ray tube comprising:

an open end portion in an approximate rectangular shape;

a neck portion for mounting an electron gun;

a yoke portion on which a deflection coil is externally mounted; and a body portion constituting a part between the open end portion and the yoke portion, the body portion having a funnel-shape whose cross section parallel with a plane including the open end portion is continuously changing in a direction from the open end portion to the yoke portion;

wherein a relationship $0<\alpha(z)<d$ is satisfied in an arbitrary cross section P(z) parallel with the plane including the open portion, where $\alpha(z)$ is an angle (°) defined between a line and a major axis (LA) of the funnel, the line being connecting an outermost part D(z) on at least one of an outer surface and an inner surface of the body portion and a center axis (C) of the funnel, and d is an angle (°) defined between a diagonal axis (DA) of the funnel and the major axis (LA); and wherein a center of an arc RD forming the outermost part D(z) of the body portion of the funnel is provided toward the major axis (LA) from the diagonal axis (DA).

10. The funnel for a cathode ray tube according to claim 9, wherein the angle $\alpha(z)$ is represented by a function of non-monotonic increasing or non-monotonic decreasing continuously changing from the open end portion (z=0) to joint portion (z=T) to the yoke portion, and having one minimum value.

11. A funnel for a cathode ray tube comprising:

an open end portion in an approximate rectangular shape;

a neck portion for mounting an electron gun;

a yoke portion on which a deflection coil is externally mounted; and a body portion constituting a part between the open end portion and the yoke portion, the body portion having a funnel-shape whose cross section parallel with a plane including the open end portion is continuously changing in a direction from the open end portion to the yoke portion;

wherein a relationship $d<\alpha(z)<90$ is satisfied in an arbitrary cross section P(z) parallel with the plane including the open portion, where $\alpha(z)$ is an angle (°) defined between a line and a major axis (LA) of the funnel, the line being connecting an outermost part D(z) on at least one of an outer surface and an inner surface of the body portion and a center axis (C) of the funnel, and d is an angle (°) defined between a diagonal axis (DA) of the funnel and the major axis (LA); and wherein a center of an arc RD forming the outermost part D(z) of the body portion of the funnel is provided opposite to the major axis (LA) from the diagonal axis (DA).

12. The funnel for a cathode ray tube according to claim 11, wherein the angle $\alpha(z)$ is represented by a function of non-monotonic increasing or non-monotonic decreasing continuously changing from the open end portion (z=0) to a joint portion (z=T) to the yoke portion, and having one minimum value.

13. The funnel for a cathode ray tube according to claim 10, wherein the angle $\alpha(z)$ and the angle d satisfy $0<|\alpha(z)-d|<10$.

14. The funnel for a cathode ray tube according to claim 13, wherein, when the outermost part D(z) is represented as (Dx, Dy) on an orthogonal coordinate defined by the major axis (LA) and a minor axis (SA) of the funnel in the arbitrary cross section P(z), Dx and Dy in a range where (z) changes from 0 to T satisfy a relationship $$Dy=A_0+A_1\cdot Dx+A_2\cdot Dx^2+\ldots+A_{n-1}\cdot Dx^{n-1}+A_n\cdot Dx^n,$$

where $A_0, A_1, A_2, \ldots, A_{n-1}$ and $A_n$ are constants, and n is a natural number.

15. The funnel for a cathode ray tube according to claim 12, wherein the angle $\alpha(z)$ and the angle d satisfy $0<|\alpha(z)-d|<10$.

16. The funnel for a cathode ray tube according to claim 15, wherein, when the outermost part D(z) is represented as (Dx, Dy) on an orthogonal coordinate defined by the major axis (LA) and a minor axis (SA) of the funnel in the arbitrary cross section P(z), Dx and Dy in a range where (z) changes from 0 to T satisfy a relationship $$Dy=A_0+A_1\cdot Dx+A_2\cdot Dx^2+\ldots+A_{n-1}\cdot Dx^{n-1}+A_n\cdot Dx^n,$$

where $A_0, A_1, A_2, \ldots, A_{n-1}$ and $A_n$ are constants, and n is a natural number.

* * * * *